US006709178B2

(12) United States Patent
Trescazes

(10) Patent No.: US 6,709,178 B2
(45) Date of Patent: Mar. 23, 2004

(54) ADAPTER FOR MAILPIECE PREPARATION ASSEMBLY

(75) Inventor: Frédéric Trescazes, Paris (FR)

(73) Assignee: Neopost Industrie, Bagneux (FR)

( * ) Notice: Subject to any disclaimer, the term of this patent is extended or adjusted under 35 U.S.C. 154(b) by 228 days.

(21) Appl. No.: 09/842,157

(22) Filed: Apr. 26, 2001

(65) Prior Publication Data

US 2002/0159814 A1 Oct. 31, 2002

(51) Int. Cl.[7] ..... B41J 29/06
(52) U.S. Cl. ..... 400/691; 400/693
(58) Field of Search ..... 400/691, 693; 312/208.1, 334.31, 334.4, 349, 350; 248/917, 916, 346.01; 101/228, 226, 219

(56) References Cited

U.S. PATENT DOCUMENTS 4,192,496 A * 3/1980 Baselice et al. ..... 198/463.3
5,513,921 A * 5/1996 Alcoran ..... 400/599.1
5,620,269 A * 4/1997 Gustafson ..... 347/104
5,820,281 A * 10/1998 Hill et al. ..... 400/621
5,862,754 A * 1/1999 Hill et al. ..... 101/228
6,230,903 B1 * 5/2001 Abbott ..... 211/190
6,409,292 B1 * 6/2002 Janowitz ..... 312/257.1

FOREIGN PATENT DOCUMENTS

| | | |
|---|---|---|
| FR | 2 622 558 | 10/1987 |
| WO | WO 97/28972 | 8/1997 |
| WO | WO 98/52755 | 11/1998 |

* cited by examiner

*Primary Examiner*—Anthony H. Nguyen
(74) *Attorney, Agent, or Firm*—Sughrue Mion, PLLC

(57) ABSTRACT

This invention relates to an adapter device comprising a platform intended to receive a digital printer and capable of receiving a folder/inserter, and an adapter assembly cooperating with the platform to support the digital printer and to position it in space (in height, length and width) with respect to the folder/inserter, by causing the inlet of the folder/inserter to correspond to the or each outlet of the digital printer.

10 Claims, 7 Drawing Sheets

ADAPTER FOR MAILPIECE PREPARATION ASSEMBLY

FIELD OF THE INVENTION

The present invention relates exclusively to the processing of mail and concerns more particularly an integrated OA assembly for preparing mailpieces.

BACKGROUND OF THE INVENTION

U.S. Pat. No. 5,628,249 already discloses an assembly for preparing mail comprising a computer, a folder-inserter and two printers, one for printing the documents, the other for printing the envelopes. Similarly, International Patent Application WO 97/28972 discloses an entirely integrated and compact unit effecting such a preparation of the mailpieces, from the printing of the documents to their being placed in envelopes.

These solutions show that the search for complete integration with a view to producing an OA assembly necessarily involves a precise choice of the type of printer. In effect, printers available on the market at the present time present totally different architectures with, for example, document outlets in single printing mode and in recto-verso mode which are completely different as to their arrangement.

Now, the mailing departments of enterprises which are conventionally equipped with franking machines and with integrated document folding and inserting machines, thus often have their own type of printer and they do not necessarily wish to change in order to conform to the set structure imposed by these prior art mail preparation systems.

In addition, for a determined position of the document and/or empty envelope inlet of these filling machines, there may correspond a plurality of document and/or empty envelope outlet positions, representative of a determined type of printer.

It is an object of the present invention to overcome the drawbacks set forth hereinabove by proposing a preferably universal adapter device allowing a folder/inserter to be connected very simply to a printer, whatever its type, in order to produce a particularly compact, autonomous mail preparation assembly well adapted to OA use. A further object of the invention is to effect such adaptation by simple manual adjustments. Yet another object of the invention is to allow the folder/inserter and the printer associated therewith to be rapidly disconnected.

SUMMARY OF THE INVENTION

These objects are attained by an adapter device comprising a platform intended to receive a digital printer and capable of receiving a folder/inserter, and an adapter assembly cooperating with the platform to support the digital printer and position it in space (in height, length and width) with respect to the folder/inserter, by causing the inlet of the folder/inserter to correspond to the or each outlet of the digital printer.

This specific structure makes it possible to produce, at low cost, a complete mail preparation assembly which integrates an existing folder/inserter and printer.

The adapter assembly comprises a chassis capable of sliding longitudinally over slideways of the platform, a deck intended to receive the digital printer and capable of being positioned in height at any one of a plurality of predetermined levels of adjustment within this chassis, and a plurality of fastening devices serving to position and immobilize the digital printer on the deck both in length and in width.

The deck preferably rests on support tabs disposed regularly along vertical rules fixed to vertical uprights of the chassis, immobilization of the deck being obtained by fixing means traversing both this deck and the uprights. The fastening means are constituted by brackets fixed in orifices at pre-established positions of the deck.

The adapter assembly advantageously slides longitudinally over slideways of the platform and may be immobilized in a plurality of positions of blockage predetermined by locking means. These slideways are preferably of telescopic type with a first rail fast with the chassis which slides in a second rail fast with the platform via a third mobile intermediate rail.

The folder/inserter is positioned on the platform via feet which are received in appropriate recentering housings made in this platform.

According to a preferred embodiment, the adapter device according to the invention further comprises a complementary structure disposed between the folder/inserter and the digital printer, allowing the documents and/or empty envelopes to be transferred from the printer to the folder/inserter whatever their outlet orientation. This complementary structure comprises, on the one hand, in its lower part, a base that may be removably mounted on the platform and provided with a housing for receiving a bin of documents of recto-verso type from the printer and, on the other hand, in its upper part, a transfer unit for transporting the documents and/or empty envelopes from the printer to the folder/inserter. The transfer unit comprises at least one horizontal type inlet in the form of a funnel, a vertical type inlet likewise in the form of a funnel, and a common outlet.

BRIEF DESCRIPTION OF THE DRAWINGS

The invention will be more readily understood on reading the following description given by way of indicative and non-limiting example, with reference to the accompanying drawings, in which.

DESCRIPTION OF PREFERRED EMBODIMENTS

Figure 1:
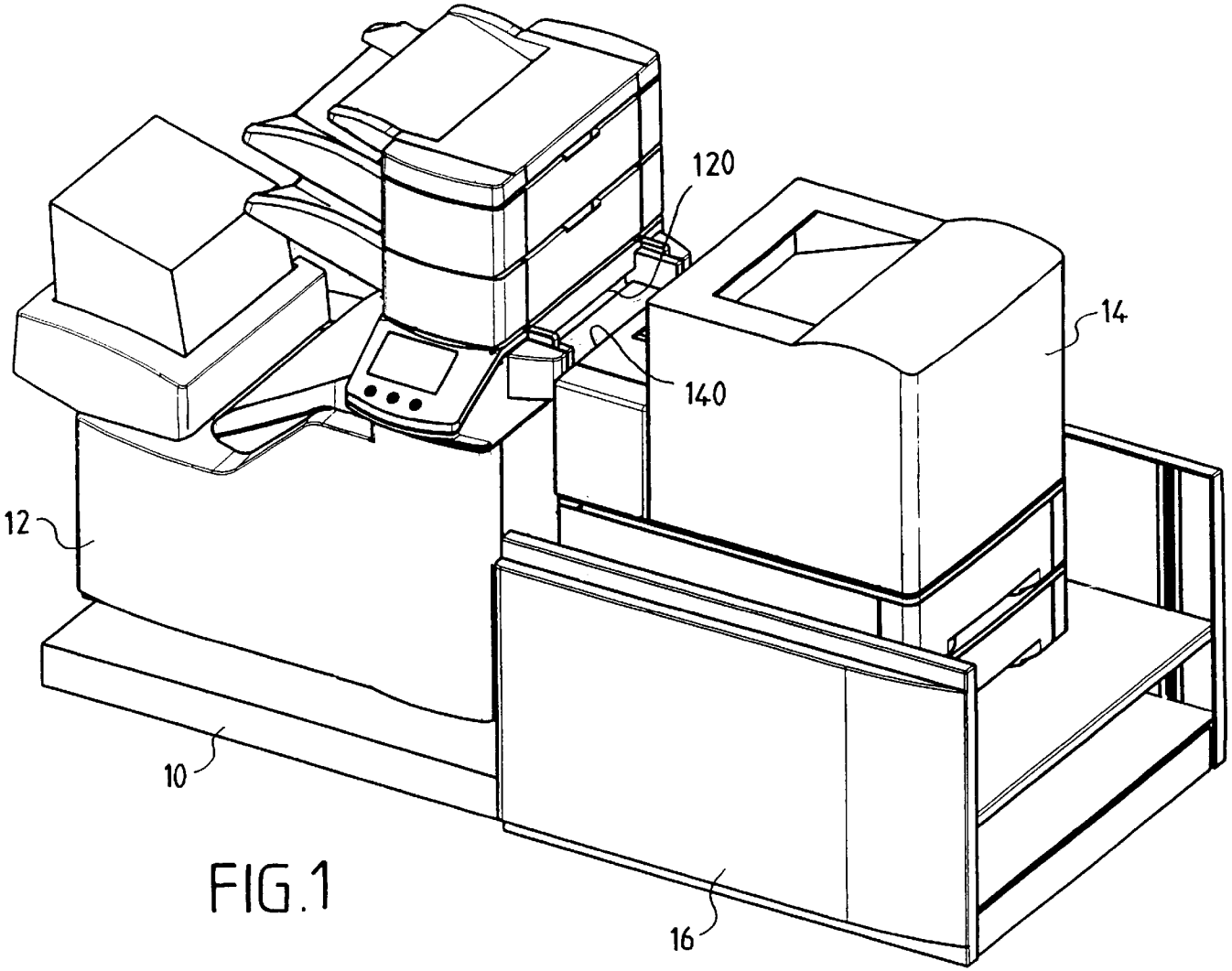
FIG. 1 shows a perspective view of a mail preparation assembly provided with an adapter device according to the invention.

Referring now to the drawings, FIG. 1 firstly shows a view in perspective of a mail preparation assembly comprising an adapter device according to the invention, employed with a "Kyocera"™ OA printer.

This adapter device of evolutive type comprises a platform 10 intended to receive a digital type printer 14 and likewise able to receive a folder/inserter 12, and an adapter assembly 16 cooperating with this platform in order to support the digital printer and to position it precisely in space with respect to the folder/inserter in order that the respective inlet 120 and outlet 140 of these two OA machines be in register (i.e. placed opposite one another).

Figure 2:
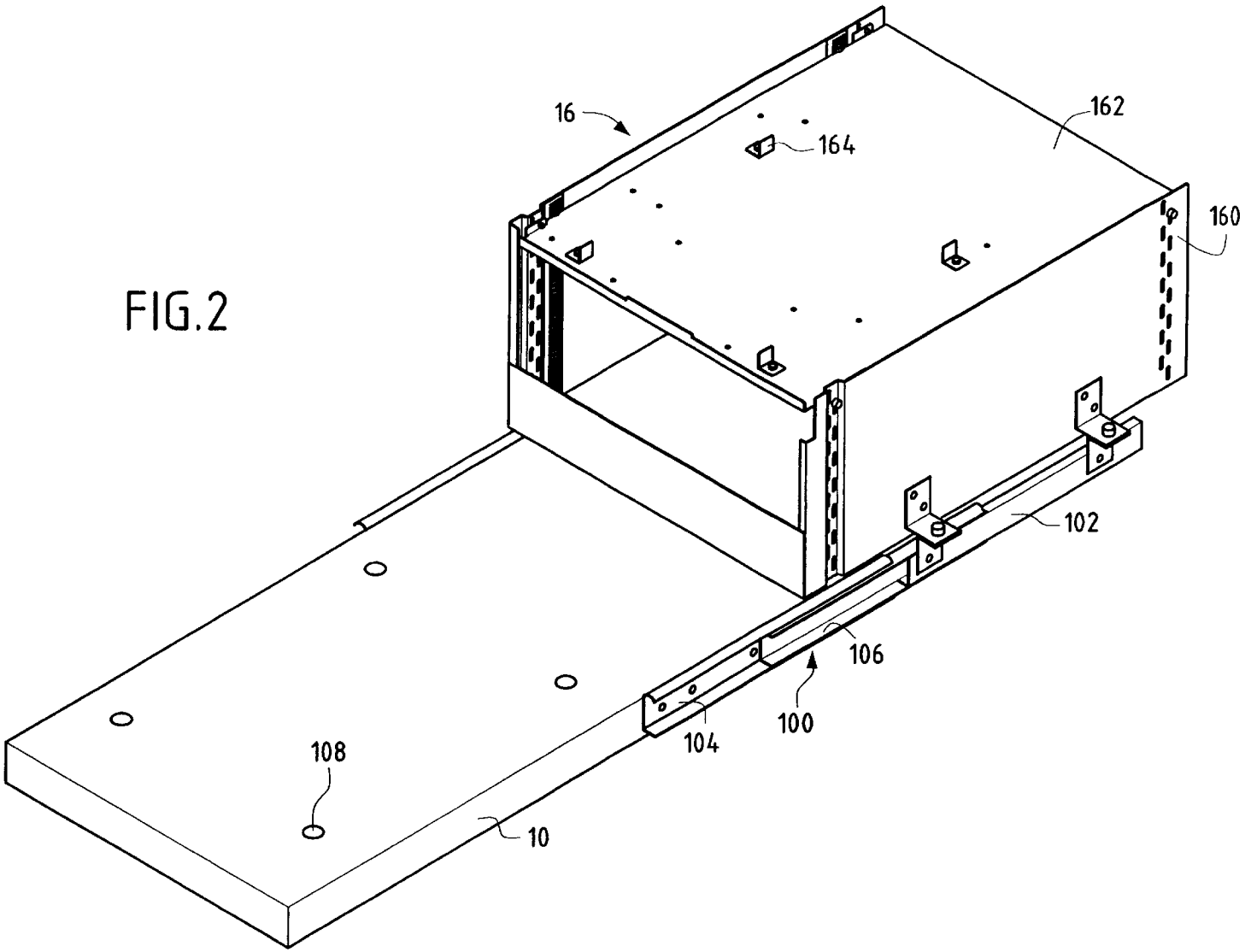
FIG. 2 shows a perspective view of the adapter device of FIG. 1 in disconnected position.

As shown in FIG. 2, the adapter assembly 16 comprises a chassis 160 capable of sliding longitudinally over slideways 100 of the platform, in order to allow an operator to move the folder/inserter 12 away or nearer by hand. This chassis supports a deck 162 intended to receive the digital printer 14 and capable of being positioned in height at any one of a plurality of predetermined levels of adjustment within this chassis 160. A plurality of fastening devices 164 serving to position and immobilize the digital printer 14 in length and width, i.e. in the longitudinal and transverse directions, is provided on the deck 162 so as to bring the inlet 120 of the folder/inserter 12 respectively in register with the outlet 140 of the digital printer 14. In order to ensure a sufficient disengagement of the chassis 160 in translation, the slideways 100 are of telescopic type with a first rail 102 fast with this chassis which slides in a second rail 104 fast with the platform 10 via a third mobile intermediate rail 106. Locking means (not shown) are provided to immobilize the chassis in a plurality of predetermined positions of blockage.

Figure 3:
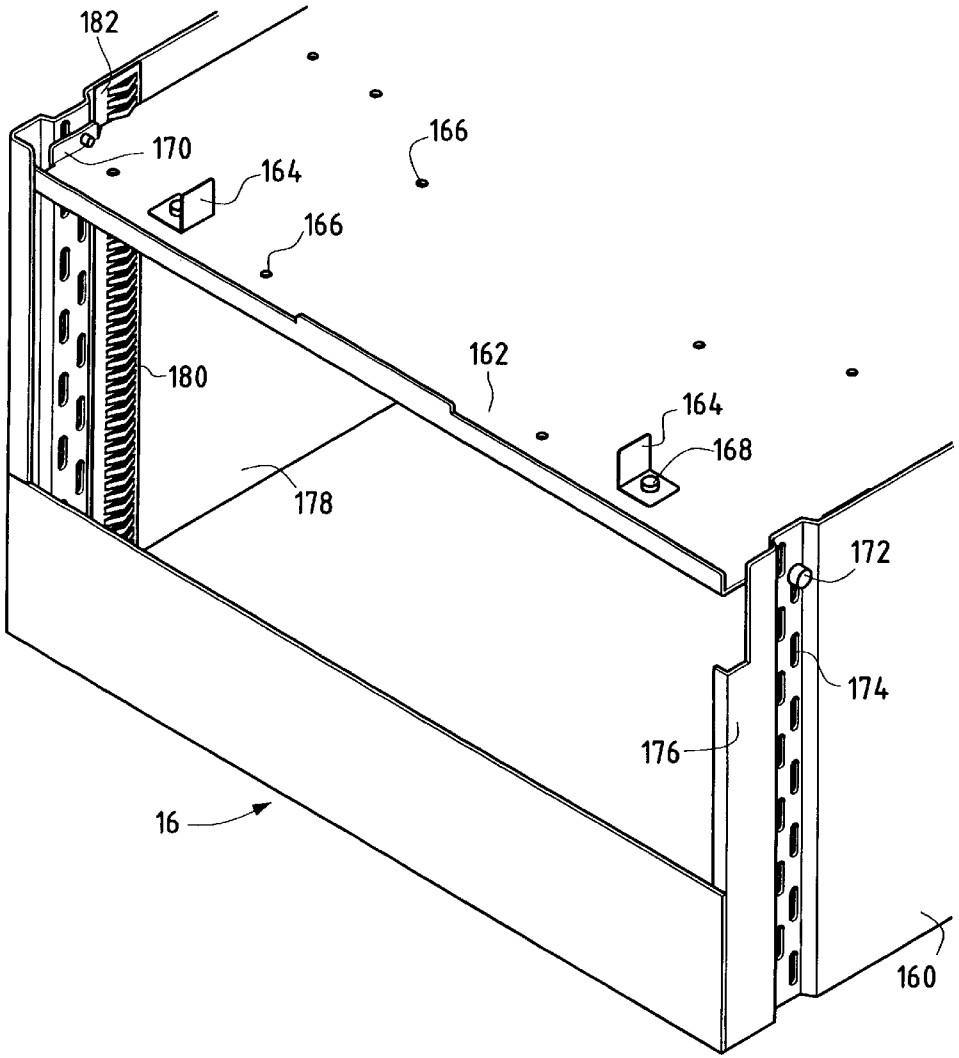
FIG. 3 is a detailed view of the adapter device of FIG. 2.

As illustrated in detail in FIG. 3, the levels of adjustment of the deck are arranged to differ by a pitch of about 5 mm, representative of a latitude of vertical fastening procured by a funnel shape usually presented by the document and/or empty envelope inlet 120 of the folder/inserter 12. To that end, the deck 162 is provided with lugs 170 which are fixed on oblong-shaped openings 174 made in vertical uprights 176, 178 of the chassis 160 (by fixing means 172, for example screws traversing both these openings and these lugs). The oblong shape of the openings makes it possible to adjust the vertical position of the deck with respect to the support tabs 180 on which it rests and which are disposed regularly along vertical rules 182 fixed to each of these uprights. The fastening devices 164 are constituted by brackets, preferably made of plastics material, disposed at pre-established positions (each corresponding to a particilar type of printer) in orifices 166 in the deck 162 and fixed thereto by a conventional clamping system 168 of screw-nut type.

The folder-inserter 12 is, on the contrary, positioned solely on the platform 10 via its feet which are received precisely in appropriate recentering housings 108 made in this platform. It will be noted that the platform may receive only the digital printer 14, the folder/inserter being placed on the floor against the adapter assembly.

Figure 4:
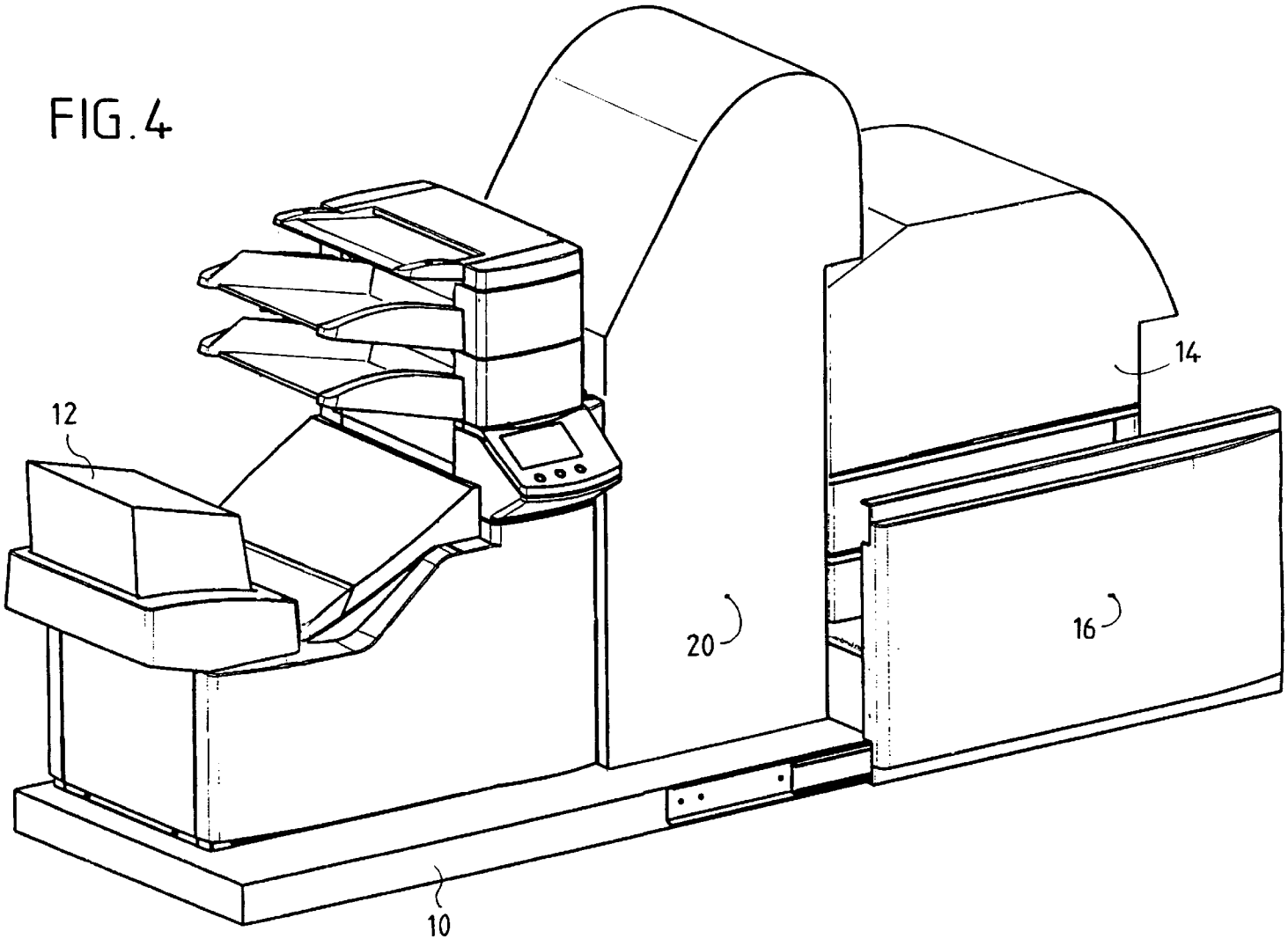
FIG. 4 is a view in perspective of a mail preparation assembly provided with an adapter device in a more universal embodiment of the invention.

FIG. 4 shows a view in perspective of a mail preparation assembly provided with a more universal adapter device according to the invention and employed with a "Lexmark"™ OA printer.

The platform 10 is in this case surmounted by a complementary structure 20 capable of connecting the majority of the digital printer outlets on the market, for example a "Lexmark"™ digital printer 14, to the inlet of the folder/inserter 12.

This structure is in the form of a vertical column with a lower part and an upper part and whose dimensions (in particular the width/thickness ratio) are optimalized as a function of the dimensions of the recto-verso modules of these printers, and of the non-horizontal outlet positions that recto-verso printed documents of certain types of printer may occupy.

It enables the documents/envelopes to be transferred from the printer 14 to the folder/inserter 12 whatever their outlet orientation, whether these documents come from a printer outlet of which the plane of the conveyance path is substantially horizontal, vertical or inclined between these extreme planes.

Figure 5:
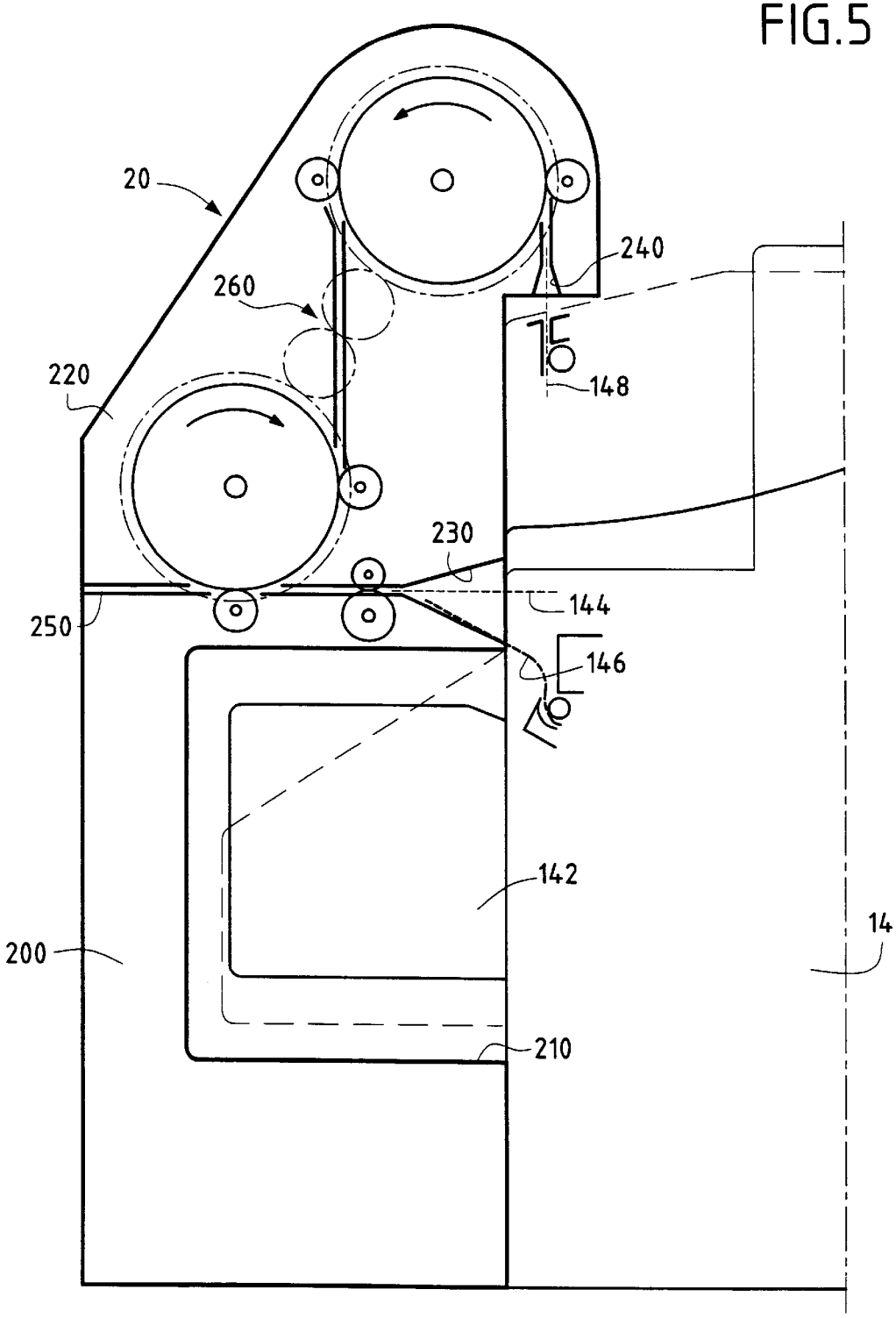
FIG. 5 is a side view in section of part of the adapter device of FIG. 4.

As illustrated in FIG. 5, the complementary structure 20 comprises in its lower part a base 200 forming body and removably mounted on the platform 10, this base being provided with a housing 210 capable of receiving a module or recto-verso type document bin 142, integrated in the printer 14. In its upper part, it comprises a transfer unit 220 provided with at least one horizontal type inlet 230 in the form of a funnel, with a vertical type inlet 240 likewise in funnel shape, with a single document/empty envelope outlet 250, and with transfer kinematics 260 for transporting the documents/empty envelopes from this inlet 230 or 240 to the common document/envelope outlet 250. These kinematics comprise for example a motorized assembly of pinions, belts and rollers defining two conveyance paths which are joined just upstream of the common document/empty envelope outlet 250.

The housing 210 made in the base 200 enables the printer 14 to be located as close as possible to the folder/inserter 12 and to reduce the dimensions of the column 20 as much as possible. Of course, this housing serves no purpose when a recto-verso module is housed directly inside the printer, as in the printer model illustrated in FIG. 1.

With a "Kyocera"™ digital printer (shown in fine lines and corresponding to the model of FIG. 1), which comprises a recto-verso module at its base, just below a document magazine, the inlet 240 is thus not employed as this printer presents a single outlet 144 for all the single, or recto-verso, documents and the envelopes and whose alignment may be effected on the horizontal inlet 230 of the column 20. Similarly, with a digital "Hewlett Packard"™ digital printer (illustrated in thick lines) of which the recto-verso module 142 may be received in the housing 210, the inlet 240 does not need to be employed either, the same outlet 146 being normally allocated to single functional mode and to the recto-verso mode. The funnel shape of the inlet 230 allows an alignment of this outlet to be made simply. On the contrary, for a "Lexmark"™ digital printer (shown in dashed and dotted lines), the vertical funnel shaped inlet 240 will be aligned on the vertical outlet 148 reserved for the recto-verso mode of this type of printer, the normal outlet 144 for its part being aligned on the horizontal funnel-shaped inlet 230 of the column 20. It will be noted that the inlets 230 and 240 of this column taper sufficiently to increase the latitude of alignment, taking into account different possible architectures of printer.

Figure 6:
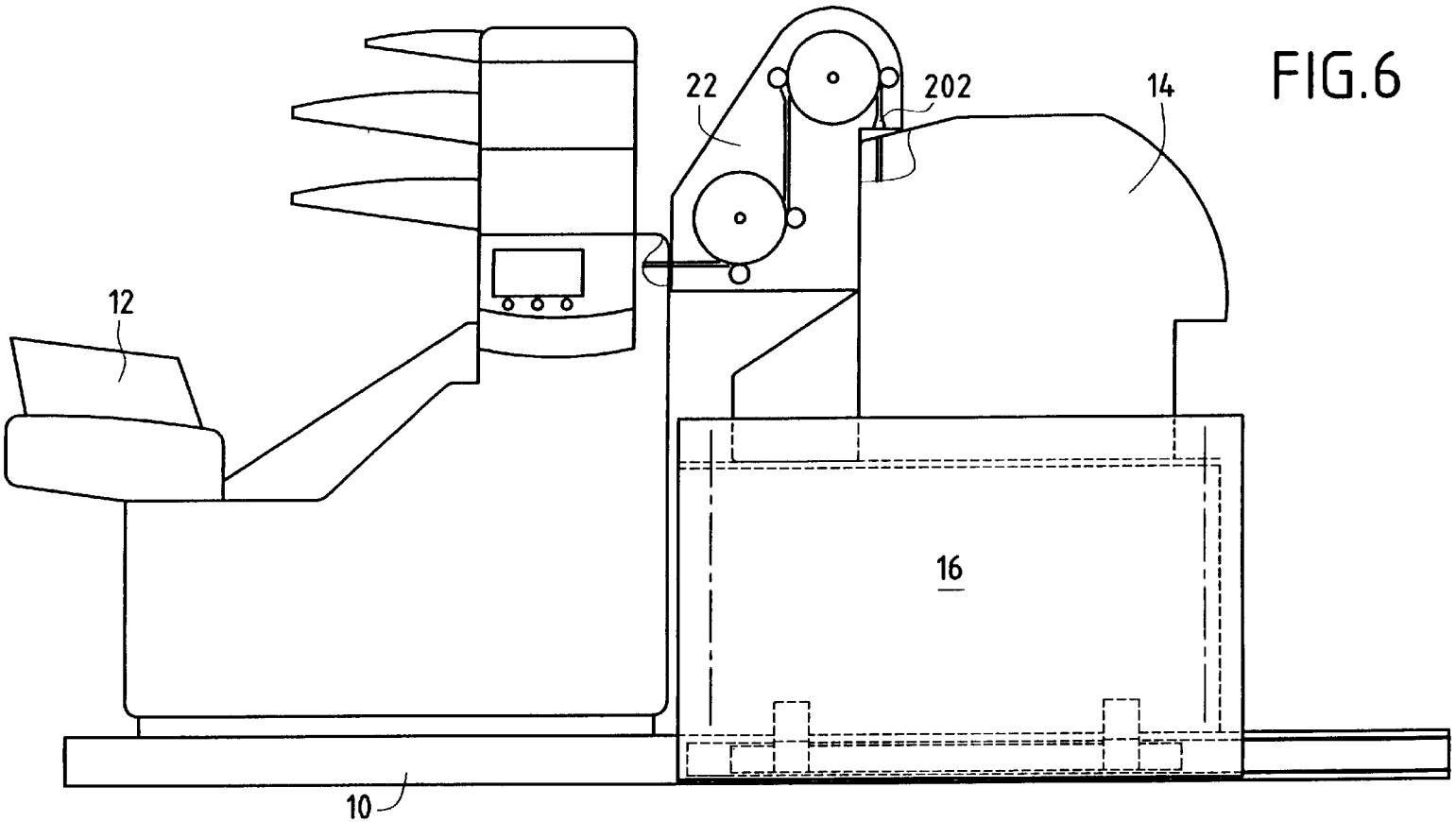
FIG. 6 is a side view of a mail preparation assembly provided with an adapter device in a first variant embodiment.
Figure 7:
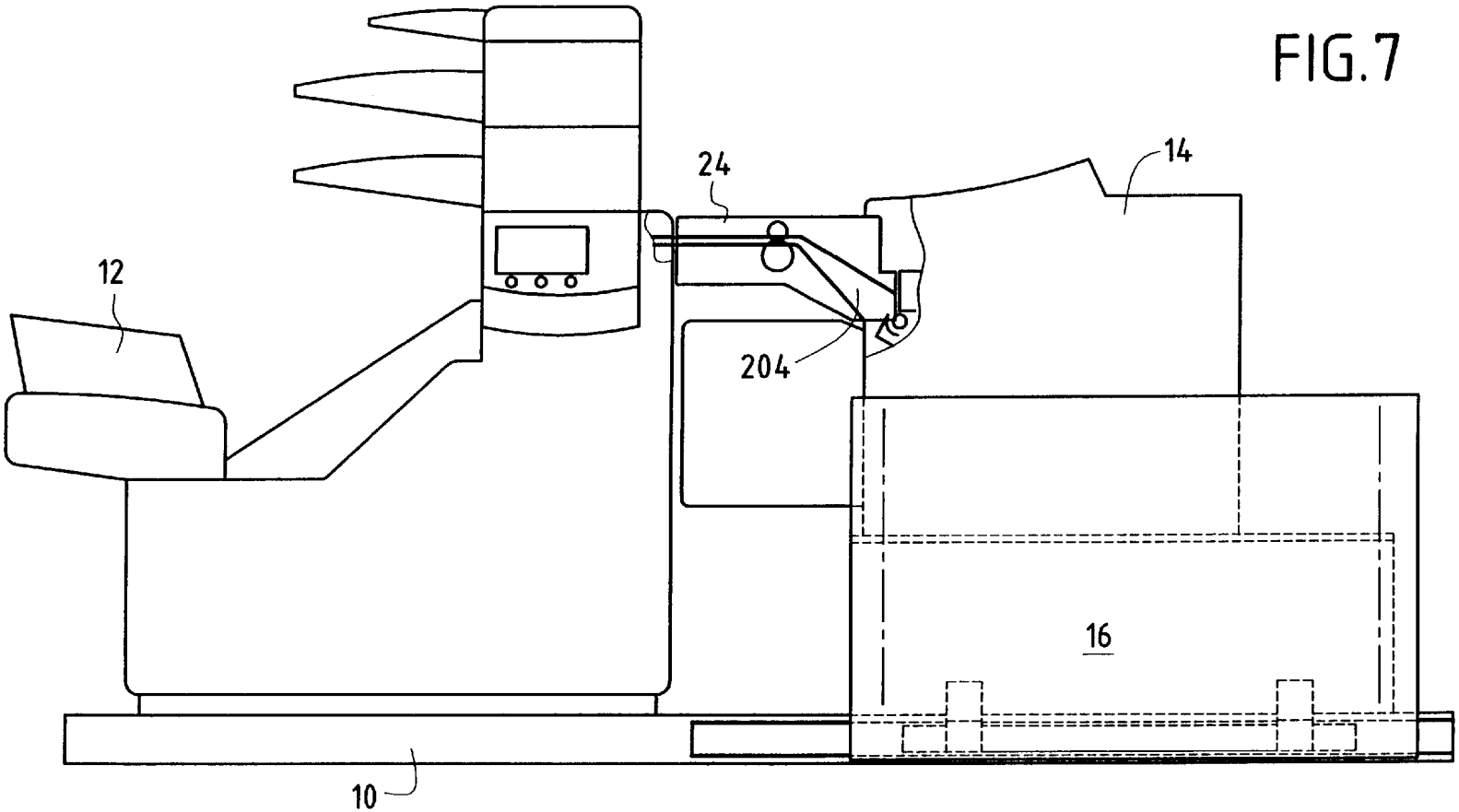
FIG. 7 is a side view of a mail preparation assembly provided with an adapter device in a second variant embodiment.

Of course, it is also possible to make specific complementary structures for any type of digital printer and in particular for each particular printer outlet, as illustrated respectively in FIGS. 6 and 7 which show transfer units for outputs of recto-verso modules of "Lexmark"™ and "Hewlett Packard"™ printers.

FIG. 6, for example, illustrates a specific transfer unit 22 provided with a single inlet 202 for recto-verso documents emerging vertically from a "Lexmark"™ printer 14. This unit to some extent takes up the upper part of column 20 illustrated in FIG. 5.

Similarly, FIG. 7 illustrates a specific transfer unit 24 provided with a single inlet 204 for receiving recto-verso documents emerging from a "Hewlett Packard"™ printer 14. There again, this unit derives from the upper part of column 20 illustrated in FIG. 5.

What is claimed is:

1. Adapter device comprising:

a platform intended to receive a digital printer and capable of receiving a folder/inserter, and an adapter assembly cooperating with the platform to support the digital printer, said adapter assembly being moveable in at least a vertical direction to position the digital printer with respect to the folder/inserter such that the inlet of the folder/inserter is aligned with the outlet of the digital printer.

2. The adapter device of claim 1, wherein said adapter assembly comprises:

a chassis slidable along said platform in a longitudinal direction, a deck intended to receive the digital printer, said deck being vertically moveable with respect to the platform between a plurality of predetermined levels of adjustment within the chassis, and a plurality of fastening devices serving to position and immobilize the digital printer on the deck both in a transverse direction and the longitudinal direction.

3. The adapter device of claim 2, wherein said chassis includes opposing vertical rules and support tabs disposed regularly along the vertical rules for supporting said deck, and wherein said chassis further includes fixing means, traversing both the deck and the uprights, for immobilizing the deck.

4. The adapter device of claim 2, wherein said fastening means include brackets fixed in orifices at pre-established positions of the deck.

5. The adapter device of claim 1, wherein said adapter assembly slides over slideways in the longitudinal direction of the platform and is adapted to be immobilized in a plurality of positions of blockage predetermined by locking means.

6. The adapter device of claim 5, wherein said slideways are telescopic with a first rail fast with the chassis which slides in a second rail fast with the platform via a third mobile intermediate rail.

7. The adapter device of claim 1, wherein said platform comprises recesses in which are received feet of the folder/inserter.

8. An adapter assembly, comprising the adapter device of claim 1, and a unit disposed between the folder/inserter and the digital printer to facilitate transfer of the documents and/or empty envelopes from the printer to the folder/inserter irrespective of orientation.

9. The adapter assembly of claim 8, wherein said unit comprises a base removably mounted on the platform and including a housing for receiving a bin of documents of recto-verso type from the printer and, a transfer unit disposed above the base for transporting the documents and/or empty envelopes from the printer to the folder/inserter.

10. The adapter assembly of claim 9, wherein said transfer unit comprises at least one horizontal type inlet in the form of a funnel, a vertical type inlet in the form of a funnel, and a common outlet.

* * * * *